United States Patent [19]

O'Brian et al.

[11] 4,365,799

[45] Dec. 28, 1982

[54] FOLDING SLIDE AND PLATFORM STRUCTURE

[76] Inventors: Edward D. O'Brian, 2125 W. Falmouth, Anaheim, Calif. 92801; William M. Plachy, 182 Cerco Rosado, San Marcos, Calif. 92069

[21] Appl. No.: 203,878

[22] Filed: Nov. 4, 1980

Related U.S. Application Data

[63] Continuation-in-part of Ser. No. 963,377, Nov. 24, 1978, abandoned.

[51] Int. Cl.[3] ..... A63G 21/00; A63B 17/00

[52] U.S. Cl. ..... 272/56.5 R; 182/27

[58] Field of Search ..... 272/56.5 R; 182/20, 182/21, 22, 23, 24, 25, 26, 27, 28, 29, 30, 31, 35, 95, 96, 104, 105, 124, 117, 119, 125, 126, 152, 156, 159, 162, 155; 297/31, 16

[56] References Cited

U.S. PATENT DOCUMENTS

| | | | |
|---|---|---|---|
| 579,328 | 3/1897 | McConnell | 182/28 |
| 640,354 | 1/1900 | Bailey | 182/27 |
| 1,229,698 | 6/1917 | Arbess et al. | 182/30 |
| 1,243,304 | 10/1917 | Jurkowski | 182/29 |
| 1,357,465 | 11/1920 | Mayer | 272/56.5 R |
| 1,545,240 | 7/1925 | Edwards | 272/56.5 R |
| 2,369,743 | 2/1945 | Langdon | 182/125 |
| 3,971,561 | 7/1976 | Wenzel | 272/56.5 R |

FOREIGN PATENT DOCUMENTS

| | | | |
|---|---|---|---|
| 343937 | 2/1931 | United Kingdom | 182/29 |
| 381640 | 10/1932 | United Kingdom | 272/56.5 R |
| 644808 | 10/1950 | United Kingdom | 182/29 |
| 1368064 | 9/1974 | United Kingdom | 182/21 |

*Primary Examiner*—Richard C. Pinkham
*Assistant Examiner*—Arnold W. Kramer
*Attorney, Agent, or Firm*—Edward D. O'Brian; K. H. Boswell

[57] ABSTRACT

Structures including a platform and a slide located adjacent to the platform which are primarily useful for play purposes can be constructed so as to fold into an essentially small, flat configuration for storage and shipment purposes. Such structures are constructed utilizing a support including two normally upright sections connected by a plurality of links or link-type structures, one of which extends between the sections and serves as the platform. The links or link-type structures used are connected to the sections so that the sections can be manipulated between an open position in which they are spaced from one another and a folded position in which the sections are adjacent to one another. A slide is connected to one of the sections by mechanical connecting structures enabling the slide to be manipulated between an open position in which it extends outwardly from the support at an angle to the horizontal when the support is in an open position and a folded position in which it extends adjacent to one of the sections when the support is in a folded position.

15 Claims, 8 Drawing Figures

FOLDING SLIDE AND PLATFORM STRUCTURE

This application is a continuation-in-part of our prior application Ser. No. 963,377 filed Nov. 24, 1978, entitled "FOLDING SLIDE AND PLATFORM STRUCTURE" and since abandoned, the entire disclosure of which is incorporated by reference.

BACKGROUND OF THE INVENTION

The invention set forth in this specification pertains to new and improved slide and platform structures. More specifically it pertains to slide and platform structures which differ from commonly utilized prior structures in that they are constructed so that they may be easily and conveniently manipulated between an open position in which they may be used for play and related purposes and a folded position in which they may be conveniently stored or shipped.

Virtually everyone is familiar with the fact that slides or slide structures are normally constructed so as to include a slide proper which is held at an angle to the horizontal by a support holding the upper end of the slide. Normally such a support consists of a ladder or ladder-type structure. Frequently such slides are constructed so that there is a small platform located at the end of the ladder adjacent to the upper end of the slide proper. Structures of this type have been proven very utilitarian for play purposes. Most commonly they are comparatively large structures which are permanently erected at playgrounds and the like.

The recognition of the desirability of slides for play purposes has led to the development of a number of different, relatively small slide-type structures. One particular type of structure which has been widely sold commercially and which is described in at least one text is constructed so as to utilize a comparatively enlarged platform located at the top of a short ladder and adjacent to the upper end of a slide and is constructed so that the space underneath the platform can be utilized as a "hidey-hole" by children for play purposes. This type of structure is quite desirable because it serves several play functions. It serves as a slide but also it serves a secondary function of providing a partially enclosed more or less confined space which can be utilized in a multitude of ways in accordance with the imagination of children.

The type of slide and platform structure noted in the preceding in which the space under the platform can be utilized as a "hidey-hole" is commonly recognized as having an inherent limitation which tends to preclude its being utilized in many facilities such as, for example, in many homes or apartments. This relates to the fact that such a structure occupies a comparatively large amount of space; frequently such space is needed for other purposes when it is not occupied by the slide-platform structure for play purposes. There is no way short of at least partially disassembling such a stucture for placing it in a relatively compact volume which can be easily and conveniently stored.

This problem of placing such an item of play equipment in a compact volume for storage purposes is disadvantageous from another standpoint. Slide and platform structures of the type indicated are normally shipped largely disassembled because it is impractical to store and ship them in a final assembled condition. Although shipping such structures largely disassembled is in a sense advantageous because of savings in shipping and manufacturing costs it is considered also disadvantageous from a commercial standpoint because frequently customers do not like to assemble products and because frequently problems are encountered in connection with such assembly.

SUMMARY OF THE INVENTION

A broad object of the present invention is to provide new and improved slide and platform structures. More specifically the invention is intended to provide such structures which can be easily and conveniently folded between an unfolded position in which said structures can be used and a folded position for storage and shipment purposes in which such structures occupy a comparatively restricted volume. A further objective of the present invention is to provide folding slide and platform structures which are constructed in such a manner as to provide adequate space underneath the platform of such structures for use as a "hidey-hole" type item of play equipment. Still other objects of the invention are to provide structures as indicated which may be easily and conveniently manufactured at a comparatively nominal cost, which may be easily and conveniently manipulated between folded and unfolded configurations or positions, and which may be easily constructed so as to withstand the normal abuse given any item of play equipment.

In accordance with this invention these objectives are achieved in a structure primarily useful for play purposes having an elongated slide adapted to be located at an angle to the horizontal during the use of the structure and having a support holding the upper end of the slide during the use of the structure in which the improvement comprises: the support including first and second normally upright sections and a plurality of linkage means extending between the sections for positioning the sections relative to one another, the first section being located closer to the slide than the second section, the linkage means connecting the sections so that the sections can be manipulated between an open position in which the sections are spaced from one another and a folded position in which the sections are close to one another, one of the linkage means comprising a platform which extends horizontally between the sections when the support is in the open position, connecting means connecting the slide to the first section for holding the slide so that it extends at an angle to the horizontal from adjacent to the platform when the support is in the open position, the connecting means enabling the slide to be moved relative to the support so as to be adjacent to the first section when the support is in the folded position and so as to extend at an angle to the horizontal outwardly from the support when the support is in the open position.

In the preceding discussion the terms "linkage means" and "connecting means" are utilized in a rather broad manner so as to describe various structures in which links or linkage-type members or connections are employed to connect various parts as indicated. These separate terms "linkage means" and "connecting means" have been adopted and used so as to avoid duplication of terminology in connection with different parts which are capable of being described using the same expressions. In the preferred embodiments of folding slide and platform structures in accordance with this invention the linkage means and connecting means indicated are used in such a manner that the complete structures of the invention can be manipulated between open and folded configurations or positions without these linkage means or connecting structures being wholly or partially connected or disconnected. If desired so as to prevent the possibility of a child manipulating these structures in such a manner as to cause an accident, various securing means such as fasteners or a conventional latch-type structure can be added to a complete folding slide and platform structure of the invention.

BRIEF DESCRIPTION OF THE DRAWINGS

The invention is best more fully explained with reference to the accompanying drawings in which.

Figure 2:
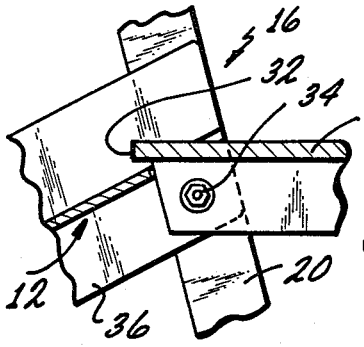
FIG. 2 is a partial cross-sectional view at an enlarged scale taken at line 2—2 of FIG. 1.

The structures illustrated in the drawings are constructed so as to utilize the operative concepts or principles of the invention set forth in the appended claims forming a part of this disclosure. It is considered that these concepts or principles can be embodied within quite a variety of diversely appearing and diversely constructed structures through the use or exercise of routine engineering skill in the field of preschool play equipment. It is considered that the invention set forth in this specification pertains to this field.

DETAILED DESCRIPTION

Figure 1:
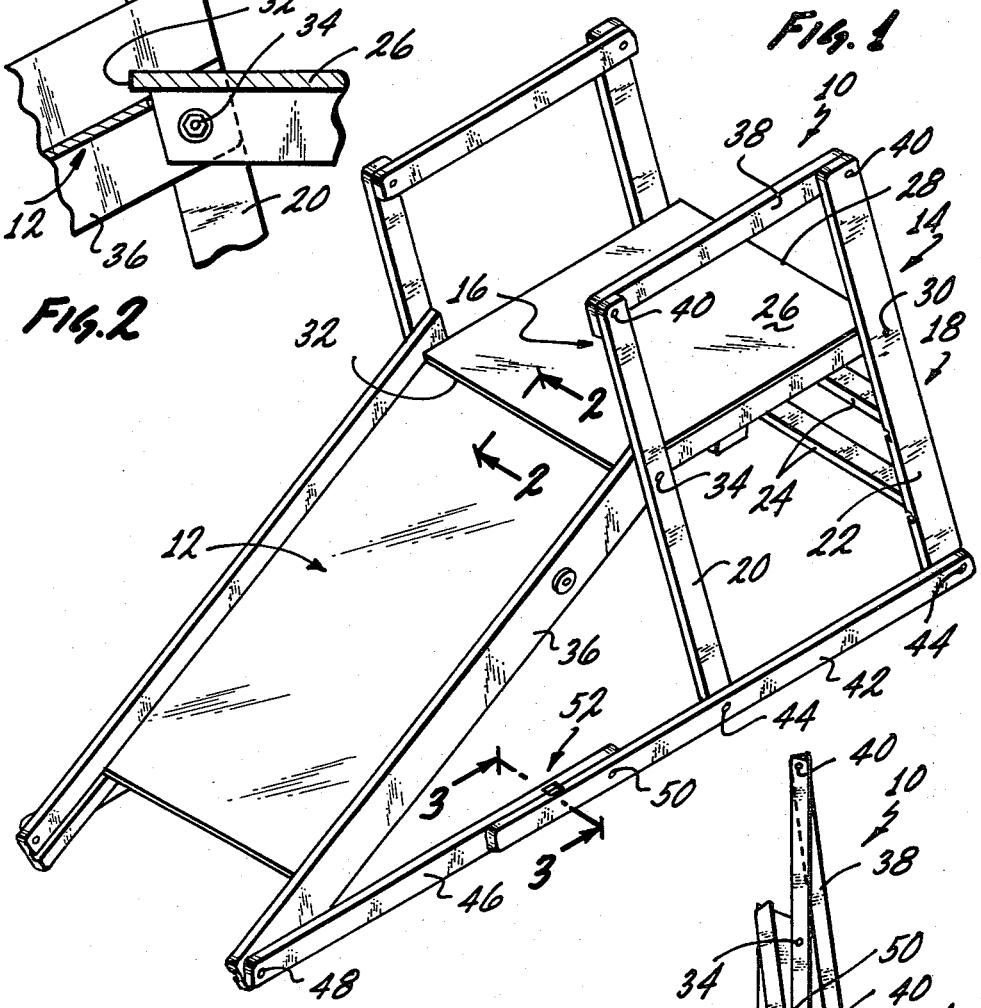
FIG. 1 is an isometric view of a presently preferred embodiment or form of a folding slide and platform structure in accordance with this invention in an open or unfolded position or configuration.
Figure 3:
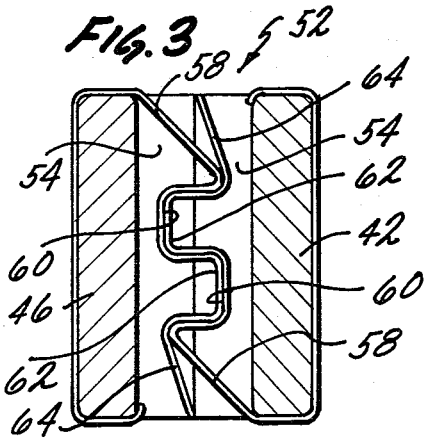
FIG. 3 is a partial cross-sectional view at an enlarged scale taken at line 3—3 of FIG. 1.
Figure 4:
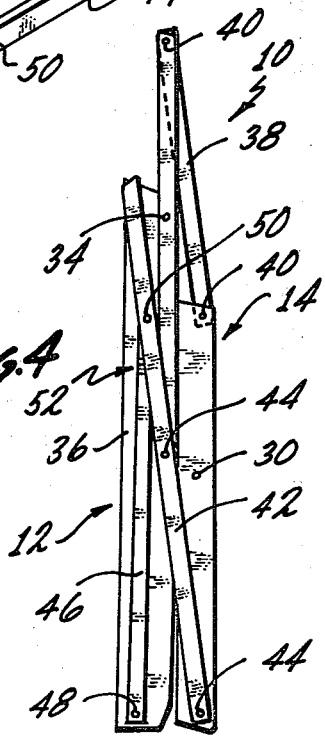
FIG. 4 is a side elevational view of the structure shown in FIG. 1 in a folded or closed position or configuration.

In FIG. 1 of the drawings there is shown a folding slide and platform structure 10 of the present invention which is constructed so as to utilize an elongated slide 12 and a support or support structure 14. The structure 10 is bilaterally symmetrical in the sense that the side (not numbered) not shown in FIG. 1 is the mirror image of the side illustrated in FIG. 1. This support 14 is constructed so as to include a first frame section 16 and a second frame section 18. These frame sections 16 and 18 normally extend in an upright manner as indicated in FIGS. 1 and 3.

The first frame section 16 includes parallel uprights or legs 20; the second frame section 18 also includes two parallel uprights or legs 22 which are connected by treads 24 serving more or less as the treads of a ladder so as to provide access to a platform 26. This platform 26 is secured adjacent to its edge 28 between the legs 22 by means of pivots 30. This platform 26 is also secured adjacent to its edge 32 between the legs 20 by means of other pivots 34. These same pivots 34 also pivotally support side boards 36 forming a part of the slide 12. The upper ends (not separately numbered) of the legs 20 and 22 are preferably connected by handrails 38. These handrails 38 are secured in place by means of other pivots 40 so as to appear as or serve essentially as links.

It is noted that these handrails 38 are parallel to the platform 26. The bottoms (not separately numbered) of the legs 20 and 22 are also secured together by what may be referred to as driving links 42. These driving links 42 are attached to the legs 20 and 22 by further pivots 44 so that they also extend parallel to the platform 26. It is noted that the driving links 42 extend generally away from the legs 20 and 22 so as to terminate generally beneath the side boards 36 of the slide 12 when the slide 12 and the support or support structure 14 are in their normal positions as illustrated in FIG. 1.

It is considered important that the side (not numbered) of the support or support structure 14 illustrated in FIG. 1 appear essentially as a large parallelogram dissected into several smaller parallelograms in order to achieve the type of folding action desired with this structure 10. This folding action requires the use of what may be referred to as connecting links 46 which extend in substantial alignment with the drive links 42 when the structure 10 is unfolded as indicated in FIG. 1. These connecting links 46 are connected by pivots 48 to the side boards 36 of the slide 12 and are connected by further pivots 50 to the drive links 42. It is noted that the connecting links 46 extend past the pivots 50 generally along the drive links 42. This is to provide an overlap which can be utilized in order to secure the links 42 and 46 together so that they cannot be pivoted relative to the pivots 50 when the entire structure 10 is in a normal open or unfolded configuration.

Although the overlapping portions of the links 42 and 46 may temporarily be secured in order to prevent folding using virtually any type of a fastener such as, for example, a common bolt or a screw (not shown), it is considered preferable to secure the links 42 and 46 utilizing retainer or fastener clips 52 as illustrated in FIG. 3 of the drawing. These clips 52 are designed to be utilized in connection with notches 54 in the links 42 and 46 which are opposed to one another when these links 42 and 46 are in an overlapping position.

Each of the clips 52 is preferably made out of a resilient material such as spring steel so as to include a substantially U-shaped base capable of fitting around a link 42 or 46, a sloping deflecting wall 58 leading to a notch 60 which in turn leads to a bump 62 carrying an angular latch end 64. These clips 52 are designed so that as they are brought toward one another the deflecting walls 58 will engage so that the clips 52 will be deformed until such time as the notches 60 contain the bumps 62 as illustrated in FIG. 3. Thereafter, the clips 52 may be released by manipulation of the ends 64 so as to bring adjacent clips 52 out of engagement with one another.

It is believed that the folding action achieved with the structure 10 will be reasonably self-obvious from the preceding and from a consideration of the drawing. In manipulating the structure 10 from an open position as shown the ends 64 will first be manipulated so as to permit folding. Then, normally the folding will be initiated by causing the links 42 and 46 to pivot relative to one another about the pivots 50. As this occurs, the pivots 50 will generally move toward the adjacent legs 20.

This in turn will tend to pivot the slide 12 from an extending position as shown in FIG. 1 to a position in which it extends generally along the first frame section 16. As this occurs the movement of the drive links 42 caused by the movement of the pivots 50 will be transmitted to the support structure 14. This will cause this support structure 14 to fold with a pivoting action corresponding to that of a common parallelogram so that the legs 22 are brought closely adjacent to the legs 20.

Although it is not normally considered desirable or necessary it is possible to construct the structure so that either a clip 52 or an overcenter toggle action involving the pivot 50 being moved to an over-center position relative to a line drawn between the pivots 44 will hold the structure 10 so that it is folded. This structure 10 may be unfolded to a normal position by a reversal of the movements described in the preceding.

From a consideration of the preceding it will be realized that the dimensions and placements of the drive links 42 and the connecting links 46 and the various pivots associated with these links 42 and 46 are quite important in obtaining the mode of operation described in the preceding. Through the use of routine techniques for laying out linkages it is possible to utilize links corresponding to the links 42 and 46 which do not extend as either or both of these links 42 and 46 in the precise structure 10. In theory it is possible to make a usable structure corresponding to the structure 10 utilizing only one drive link 42 and one connecting link 46. When only one each of these links are used preferably the two links employed should be located midway between the sides (not numbered) of the structure 10. The use of a separate drive and connecting link 42 and 46 at each of such sides (not numbered) as illustrated is considered preferable in preventing any sort of binding which might interfere with the desired folding or unfolding.

Figure 5:
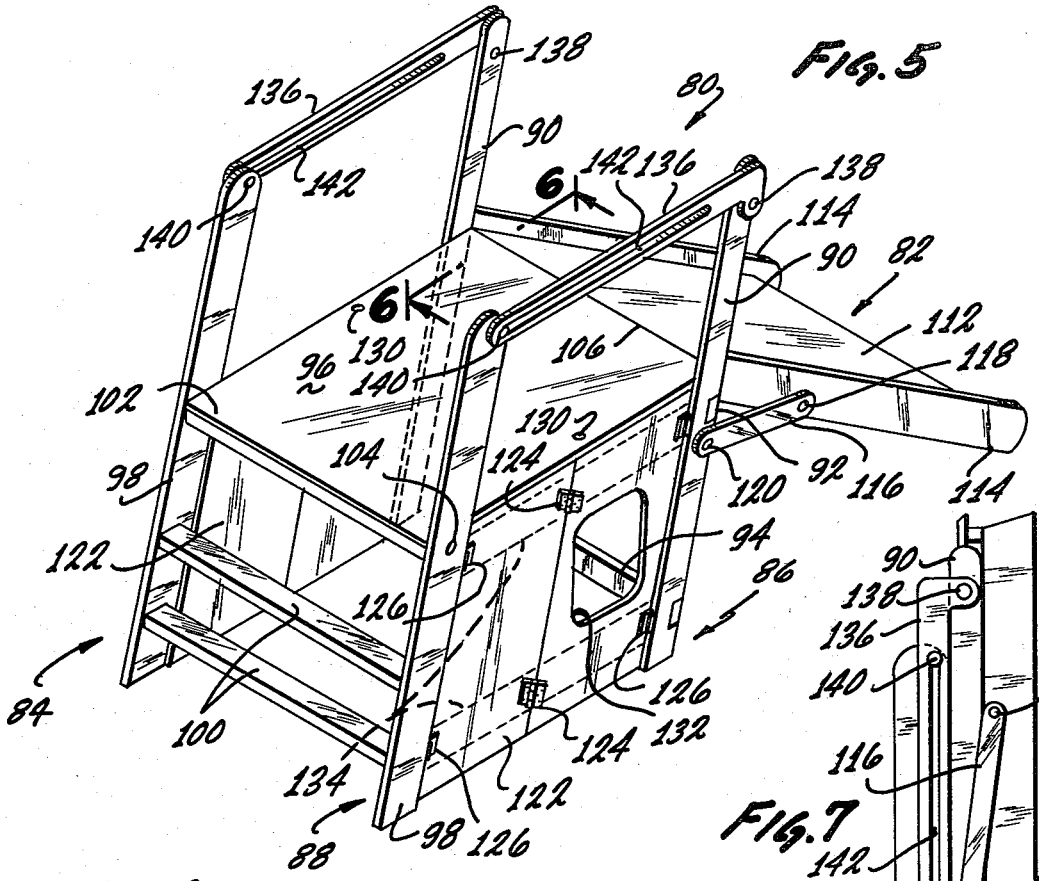
FIG. 5 is an isometric view of a modified form of a folding slide and platform structure in accordance with this invention in an unfolded or open configuration or position.
Figure 6:
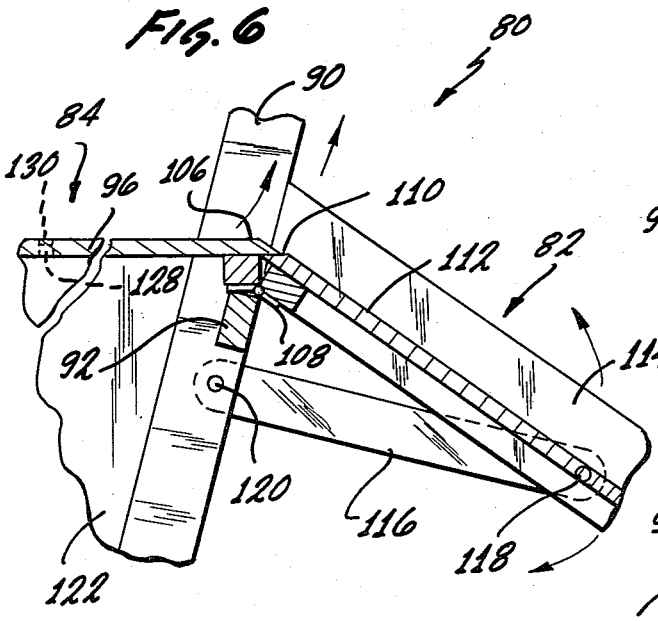
FIG. 6 is a partial cross-sectional view at an enlarged scale taken at line 6—6 of FIG. 5.

In FIGS. 5 through 8 of the drawings there is shown a modified folding slide and platform structure 80 in accordance with the present invention which in many respects is quite similar to the previously described structure 10. The structure 80 is also bilaterally symmetrical in the sense that the side (not numbered) not shown in FIG. 5 is the mirror image of the side illustrated in FIG. 5. The structure 80 includes an elongated slide 82 and a support or support structure designated generally by the numeral 84. This support 84 is constructed so as to include a first frame section 86 and a second frame section 88.

The frame section 86 includes two parallel uprights 90 which are held with respect to one another by two parallel cross-braces 92 and 94. The cross-brace 92 is located immediately adjacent to and below a platform 96. The second frame section 88 includes two uprights 98 which are held parallel to one another by means of ladder-like treads 100. The uprights 90 are spaced from one another the same amount as the uprights 98.

An edge 102 of the platform 96 is secured to the uprights 98 by means of pivots 104 so that this platform 96 can be pivoted relative to the second frame section 88. An edge 106 of the platform 96 which is spaced from and parallel to the edge 102 is secured by an elongated hinge 108 to a normally upper end 110 of the bottom 112 of the slide 82. This slide 82 includes sides 114 which support the bottom 112. These sides 114 are located from one another the same distance as the uprights 90 are located from one another. Each of the sides 114 is connected to an upright 90 by means of a link 116. These links 116 are secured to the sides 114 by means of pivots 118 and to the uprights 90 by means of other pivots 120.

The support 84 is constructed so that the uprights 90 and 98 are connected by means of links 122 shaped as side panels. Each of these side panels 122 is in the shape of a parallelogram so that the two panels 122 at either side (not separately numbered) of the structure 80 will fit with respect to one another so as to enclose the area or space (not numbered) generally between an upright 90 and an upright 98 when the structure 10 is in an open position. These panels 122 at a side (not separately numbered) of the structure 80 are joined together by hinges 124 and are connected to the uprights 90 and 98 by means of other hinges 126 in such a manner that the panels 122 can fold inwardly so that the hinges 124 approach one another when the structure 80 is in a folded configuration or position. These panels 122 are preferably dimensioned so that the platform 96 rests upon them when the structure 80 is in an unfolded or open position so that they serve to support this platform 96 in a desired operative position as illustrated in FIG. 5.

If desired at least one of the panels 122 at each side (not separately numbered) of the structure 80 can be provided with a small upwardly extending pin 128 which is adapted to fit within a corresponding opening 130 within the platform 96 when the structure 80 is in an unfolded or open position. This pin 128 and opening 130 of the structure 80 constitutes a simplified form of latch or latch structure which minimizes the possibility of the panels 122 folding inwardly of the entire support 84 as the structure 80 is employed for play purposes. Depending upon specific details such as the tolerances employed in the structure 80 some minor temporary deformation of the platform 96 may or may not be required in engaging or disengaging the pins 128 within the openings 130.

The panels 122 can be varied to a significant extent. If desired for play purposes or aesthetic reasons these panels may be provided with various openings 132 of various different sizes. Such openings 132 may even be large enough so as to permit a child to crawl within the space (not numbered) under the platform 96 when the structure 80 is in an open or unfolded position. If desired a panel 122 can consist merely of an open frame (not shown). In order to facilitate access to the space under the platform 96 when the structure 80 is in an unfolded or open position a particular panel 122 can be replaced by two links 134 as shown by dotted lines in FIG. 5 of the drawings.

Figure 7:
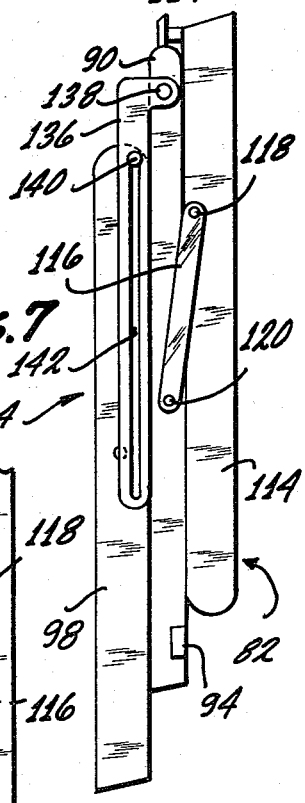
FIG. 7 is a side elevational view of the structure shown in FIG. 5 in a folded or closed position or configuration.
Figure 8:
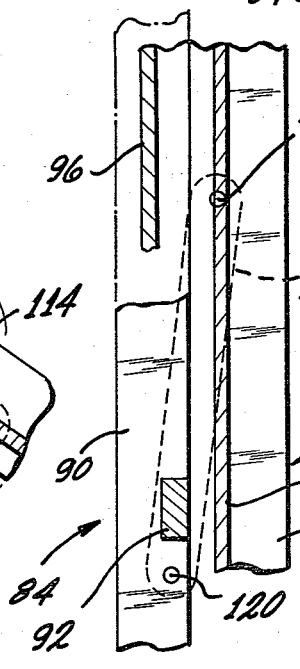
FIG. 8 is a partial cross-sectional view corresponding to FIG. 6 showing the parts illustrated in FIG. 6 in a folded or closed position or configuration.

The structure 80 includes two handrails 136, each of which is pivotally mounted by means of a pivot 138 at the upper end of an upright 90. Other pivot pins 140 are provided on the uprights 98 so as to project through elongated slots 142 in the handrails 136. This forms a type of pin and slot or sliding connection enabling the pins 140 to slide within the slots 142 as there is pivoting of the handrails 136 relative to the uprights 90 in manipulating the structure 80 from an unfolded or open position as indicated in FIG. 5 to a folded or collapsed position as indicated in FIG. 7 or vice versa.

The folding and unfolding of the structure 80 is essentially a relatively simple matter involving a number of coordinated pivoting actions. To fold the structure 80 from the open or unfolded position or configuration illustrated in FIG. 5 the sides 114 of the slide 82 adjacent to the end 110 are lifted upwardly. This will normally cause any pins 128 used to be released from the openings 130 so as to free the panels 122 so that they can fold generally inwardly within a support 84. As the slide 82 is manipulated in this manner the platform 96 will commence to pivot relative to the second frame 88 and this will supply a force component drawing the second frame 88 generally toward the first frame 86. This will result in a tendency for the panels 122 to fold relative to the frames 86 and 88 so as to lie generally within these frames. Concurrently the pins 140 will move in the slots 142 as the handrails 136 pivot relative to the first frame 86 to accommodate this motion. As upward movement of the slide 82 continues this slide 82 will move so as to be parallel to the frame 86. At such time as the slide 82 abuts the frame 86 the panels 122 will be folded flat generally between the frames 86 and 88.

The structure 80 may be unfolded by essentially a reverse of the operation described in the preceding. As the structure 80 approaches the completely unfolded or open configuration or position the sides 114 of the slide 82 will abut against the uprights 90 so as to limit further movement of the slide 82 relative to the support 84 and concurrently the platform 96 will hit against the cross-brace 92 for the same purpose. This cross-brace 92 will, of course, support the platform 96 and, because the slide 82 is attached to it, support this slide 82 in the final unfolded or open position. In reaching this final position a minor amount of stress may have to be applied to the platform 96 in order to make sure that the pins 128 fit within the openings 130. Whether this will be the case or not will depend upon factors as indicated in the preceding.

It is possible to construct the structure 80 with sufficiently close tolerances and with the hinges 124 and 126 located on opposite sides of the panels 122 so as to create a toggle-type action serving to hold the structure 80 in an unfolded or open position or configuration. In achieving such a toggle action it is necessary for the platform 96, the links 116 and the slide 82 to cooperate with one another so as to limit the movement of the frames 86 and 88 away from one another to a sufficient extent so that there is a minor amount of temporary material deformation as the panels 122 are moved into or out of a final unfolded configuration or position in which they are coplanar.

It is believed that it will be apparent from the aforegoing that the two structures 10 and 80 are in many respects similar but that they involve somewhat different folding and unfolding actions. In the structure 10 the links 40 and 42 and the platform 26 cooperate so as to serve as a linkage system or means which connects the sections 16 and 18 of the support 14 so as to permit folding and unfolding of these sections 16 and 18 relative to one another. As opposed to this in the structure 80 the panels 122 and the platform 96 serve as a different type of linkage or linkage means permitting folding and unfolding.

In the structure 80 the platform 96 serves this function in cooperation with the slide 82 and the links 116, whereas in the structure 10 the slide 12 is not interconnected to the linkage system enabling the sections 16 and 18 to be moved with respect to one another. However, in the structure 10 the slide 12 moves during folding and unfolding in accordance with the movement of the sections 16 and 18 because of the action of the various links 42, 62, 52 and 58.

In the structure 10 these various links 42, 62, 52 and 58 clearly constitute a connecting linkage type structure or means which is used so as to control the position of the slide 12 relative to the support 14 during folding and unfolding. In the structure 80 the links 116 cooperate with the slide 82 and the platform 96 so that the platform 96 and the links 116 together serve as a connecting linkage-type structure or means relating the position of the slide 82 with respect to the support 84. It will be apparent from this that the platform 96 serves two functions in the structure 80. It serves as a part of the linkage means or structure permitting the sections 86 and 88 to move toward and adjacent from one another and it also serves as part of the connection structure determining the position of the slide 82.

It is considered that anyone reasonably familiar with the design and utilization of linkages could easily modify the structure 80 so as to substitute several links in approximately the same location occupied by the platform 96 on the exposed surfaces of the frames 86 and 88 to control the position of the platform 96 and to substitute for the exact platform 96 shown two panels (not shown) corresponding to the panels 122 pivotally connected together and pivotally connected to the frames 86 and 88 in the manner in which the panels 122 are connected. Such a modification would convert the support 84 so that it would fold and unfold in the manner of a conventional Sarrus linkage. Such a modified structure is not considered desirable because a structure as shown and described serves to minimize the number of parts required and avoids a platform folding intermediate its ends.

It would be possible to encumber this specification with an extremely prolonged discussion as to various design modifications which can be made in the specific structures illustrated through the use or exercise of routine engineering skill. It is also considered that it would be possible to encumber this specification with a significant discussion as to possible alternate uses of the linkage or connecting systems described in connection with the specific structures 10 and 80. These structures are considered to be capable of a variety of diverse uses. Thus, for example, by omitting the portions of the uprights 20 and 30 and 90 and 98 above the platforms 26 and 96 in the structures 10 and 80 shown and by appropriate variation in dimensions so as to make these uprights extend vertically the linkage systems described can be modified so as to be used as platforms holding the wheels of a vehicle above the normal ground level for repair and maintenance purposes.

We claim:

1. A structure having an elongated slide normally located at an angle to the horizontal and a support normally located to hold the upper end of said slide in its normal position, said structure having sides which are spaced from one another, in which the improvement comprises:

said support including two sets of legs, one leg of each of said sets being located at each of said sides of said structure, said support also including link means and a platform extending horizontally in its normal position, said link means connecting said sets of legs so as to permit said sets of legs to be moved between their normal position and a folded position in which they are adjacent to one another, said platform having an end pivoted to at least one of said sets of legs, the other end of said platform being pivoted to the upper end of said slide, and other link means connecting said support and said slide and being connected to said support so as to automatically transfer motion from said support to said slide when said support is moved between its normal position and a folded position so as to concurrently move said slide so that it is moved from its normal position to a folded position in which it extends adjacent to legs of said sets of legs, one of said link means being pivotally connected between the sets of legs and the other of said link means being pivotally connected between said slide and one of said sets of legs and extending outwardly from said support generally toward said slide, either one of said link means being foldable whereby on the folding thereof the sets of legs are moved parallel to one another so that said slide and said support are folded relative to one another.

2. A structure as claimed in claim 1 wherein:

said one of said link means is a positioning link means and said other of said link means is a connecting link means, said positioning link means being connected to said sets of legs to that on being folded said sets of legs are moved generally towards one another from said normal position to said folded position, a first end of said platform being located adjacent to and being pivoted to the upper end of said slide and being unattached to a first of said sets of legs, another, second end of said platform being pivotally attached to a second set of said legs located on the side of said first set of legs remote from said slide, said connecting link means pivotally connecting said upper end of said slide to said first set of legs so as to permit said upper end of said slide to pivot upwardly during folding of said support as said first and said second sets of legs move adjacent to one another, said platform engages said positioning link means when said slide and said support are in their normal positions so as to hold said positioning link means against folding, said platform disengaging said positioning link means so as to permit folding of said positioning link means as said first end of said platform is moved upwardly from its normal position.

3. A structure as claimed in claim 2 wherein:

said positioning link means comprises two separate sets of positioning links, the links of each of said sets being located at respective sides of said structure, at least some of said positioning links being shaped as panels so as to form an enclosure located generally beneath said platform and generally between said sets of legs when said support and said slide are in said normal positions.

4. A structure as claimed in claim 2 wherein:

said legs of said sets of legs extend upwardly beyond said platform when said support and said slide are in their normal position, and including a collapsible handrail means located at each of said sides of said structure so as to extend between the upper extensions of the legs at such side.

5. A structure as claimed in claim 1 wherein:

said platform engages said positioning link means when said slide and said support are in their normal positions so as to hold said positioning link means against folding, said platform disengaging said positioning link means so as to permit folding of said positioning link means as said first end of said platform is moved upwardly from its normal position, said positioning link means comprises two separate sets of positioning links, the links of each of said sets being located at respective sides of said structure, at least some of said positioning links being shaped as panels so as to form an enclosure located generally beneath said platform and generally between said sets of legs when said support and said slide are in said normal positions, said legs of said sets of legs extend upwardly beyond said platform when said support and said slide are in their normal position, and including a collapsible handrail means located at each of said sides of said structure so as to extend between the upper extensions of the legs at such side, tread means located beneath said second end of said platform and extending between said legs of said second set of legs, cross-brace means extending between said legs of said first set of legs, said first end of said platform being supported by said cross-brace means when said slide and said support are in their normal positions.

6. A structure as claimed in claim 1 including:

tread means located beneath said second end of said platform and extending between said legs of said second set of legs, cross-brace means extending between said legs of said first set of legs, said first end of said platform being supported by said cross-brace means when said slide and said support are in their normal positions.

7. A structure having an elongated slide normally located at an angle to the horizontal and a support normally located to hold the upper end of said slide in its normal position, said structure having sides which are spaced from one another, in which the improvement comprises:

said support including two sets of legs, one leg of each of said sets being located at each of said sides of said structure, said support also including a platform extending between said sides of said structure and extending between said sets of legs, said support also including drive link means extending between said sets of legs, said sets of legs, said platform and said drive link means being pivotally connected together so as to appear as a parallelogram when viewed from either side of said structure, said platform and said drive link means pivotally connecting said sets of legs so that said sets of legs are capable of being pivoted between a normal position in which said sets of legs are spaced from one another and a folded position in which said sets of legs are adjacent to one another, the upper end of said slide being pivoted to the legs of said first set of legs immediately adjacent to the connection of said first of said sets to said platform, connecting link means pivotally connected to said slide remote from said support, said connecting link means also being pivotally connected to said drive link means at a point remote from said slide on an extension of said drive link means extending outward from said support towards said slide, said connecting link means and said drive link means being capable of automatically pivoting said slide relative to said first set of legs during folding of said connecting link means with respect to said drive link means about said remote point for folding said support so that said slide extends generally parallel to said first set of legs when said sets of legs are in said folded position and so that said slide extends in its normal position when said sets of legs are spaced from one another.

8. A structure as claimed in claim 7 wherein:

said drive link means and said connecting link means overlap when said slide and said support are in their normal position, and including cooperating fastening means on said drive and connecting link means where said drive and connecting link means overlap for securing said drive and said connecting link means against relative movement when said slide and said support are in their normal positions so as to prevent folding of said slide and said support from their normal positions.

9. A structure as claimed in claim 8 wherein:

said fastening means are capable of automatically securing said drive and said connecting link means together when said slide and said support are pivoted into their normal positions.

10. A structure as claimed in claim 7 including:

stair treads secured to and extending between the legs of said second of said sets, said platform being pivotally connected to said legs of said second of said sets above said stair treads.

11. A structure as claimed in claim 7 wherein:

said support includes two handrail links, one of said handrail links being located along one side of said structure, the other of said handrail links being located along the other side of said structure, each of said handrail links being pivotally connected to legs of said sets of legs so as to appear as an additional parallelogram constituting an extension of said parallelogram when viewed from a side of said structure.

12. A structure as claimed in claim 7 wherein:

there are two of said drive links and two of said connecting links, one of said drive links and one of said connecting links being located at each side of said structure.

13. A structure as claimed in claim 12 wherein:

said drive and connecting links at each side of said structure overlap when said slide and said support are in their normal positions, and co-acting fastening means located on said drive and said connecting links where said links overlap at each side of said structure for securing said structure against folding from said normal position of said slide and said support.

14. A structure as claimed in claim 7 including:

stair treads secured to and extending between the legs of said second of said sets, said platform being pivotally connected to said legs of said second of said sets above said stair treads, and wherein said support includes two handrail links, one of said handrail links being located along one side of said structure, the other of said handrail links being located along the other side of said structure, each of said handrail links being pivotally connected to legs of said sets of legs so as to appear as an additional parallelogram constituting an extension of said parallelogram when viewed from a side of said structure, there are two of said drive links and two of said connecting links, one of said drive links and one of said connecting links being located at each side of said structure, said drive and connecting links at each side of said structure overlap when said slide and said support are in their normal positions, and co-acting fastening means located on said drive and said connecting links where said links overlap at each side of said structure for securing said structure against folding from said normal position of said slide and said support.

15. A structure as claimed in claim 14 wherein:

said fastening means are capable of automatically securing said drive and said connecting link means together when said slide and said support are pivoted into their normal positions.

* * * * *